US006552501B2

(12) United States Patent
Ito et al.

(10) Patent No.: US 6,552,501 B2
(45) Date of Patent: Apr. 22, 2003

(54) DISCHARGE LAMP LIGHTING CIRCUIT WITH PROTECTION CIRCUIT

(75) Inventors: Masayasu Ito, Shizuoka (JP); Hitoshi Takeda, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 09/901,399

(22) Filed: Jul. 9, 2001

(65) Prior Publication Data

US 2002/0047641 A1 Apr. 25, 2002

(30) Foreign Application Priority Data

Jul. 10, 2000 (JP) ..... 2000-208134

(51) Int. Cl.[7] ..... G05F 1/00

(52) U.S. Cl. ..... 315/308; 315/307; 315/83; 315/119; 307/10.8

(58) Field of Search ..... 315/307, 308, 315/291, 88, 91, 82, 83, 119, 120, 127, 360, 224, 225, DIG. 7; 361/75, 78, 79, 88, 86, 90, 91.1, 91.2, 91.3; 307/10.8

(56) References Cited

U.S. PATENT DOCUMENTS 5,151,631 A 9/1992 Oda et al. ..... 315/127
5,194,779 A * 3/1993 Segoshi et al. ..... 307/10.8
5,278,452 A 1/1994 Matsumoto et al. ..... 307/10.8
5,463,287 A * 10/1995 Kurihara et al. ..... 315/209 CD
5,592,146 A * 1/1997 Kover, Jr. ..... 307/10.8
5,744,916 A * 4/1998 Kawabata et al. ..... 315/225
5,783,908 A * 7/1998 Toda et al. ..... 315/224
5,936,361 A * 8/1999 Yamashita et al. ..... 359/161
5,973,457 A * 10/1999 Yamashita et al. ..... 313/318.01
6,008,594 A * 12/1999 Kita et al. ..... 315/247
6,087,776 A * 7/2000 Yamashita et al. ..... 315/225

* cited by examiner

*Primary Examiner*—Don Wong
*Assistant Examiner*—Ephrem Alemu
(74) *Attorney, Agent, or Firm*—Fish & Richardson P.C.

(57) ABSTRACT

In a discharge lamp lighting circuit 1, a control circuit 7 detects a failure in a discharge lamp 8 or the lighting circuit to stop supplying the power to the discharge lamp 8 or stop the operation of the lighting circuit, or lights another light source as a substitute light source for the discharge lamp and notifies the occurrence of a failure when the discharge lamp 8 can no longer be lit. A delay time generator circuit 31 is provided for a failure detection/determination circuit 22 such that the foregoing functions are prohibited until a predefined time period is elapsed after the time switch means SW1, SW2 are substantially simultaneously switched on to cause the lighting circuit to start operating.

5 Claims, 12 Drawing Sheets

DISCHARGE LAMP LIGHTING CIRCUIT WITH PROTECTION CIRCUIT

BACKGROUND OF THE INVENTION

The present invention relates to techniques for preventing circuit malfunctions to take reliable safety measures in a discharge lamp lighting circuit which is configured to supply the power to a discharge lamp and a control circuit when switching means arranged on respective power supply paths, which are provided to receive two or more power supply lines, are switched on in synchronism with one another.

As a lighting circuit for a discharge lamp (metal halide lamp or the like), a configuration comprising a direct current power supply circuit, a direct current-to-alternating current converter circuit, and a starter circuit (so called a starter circuit) is known.

For example, the lighting circuit is supplied with the power from a direct current power source through an over-current protecting element (a fuse or the like) and a lighting switch, and a control circuit is provided for controlling the power supplied to a discharge lamp. A power supply voltage supplied to the control circuit may be the same voltage as the direct current voltage inputted to the lighting circuit, used as it is, or may be produced from the direct current voltage by a regulated voltage power supply circuit.

When a discharge lamp experiences a failure in lighting or when an input voltage to a lighting circuit presents an abnormal value, the operation of the lighting circuit is stopped to prevent safety hazard to a human body due to a high voltage or to obviate damages such as fuming, firing and so on resulting from an excessive power output.

However, in a circuit which is configured such that a control circuit receives the same power supply input as alighting circuit for operation, when the power supply from a direct current power supply is interrupted by an over-current protecting element, the power supply to the control circuit is also stopped, thereby failing to take sufficient safety measures (for example, lighting a substitute light source, alarming the occurrence of a failure, and so on).

It is therefore contemplated to provide a switch means on each of power supply paths such that the power supply can be received on two or more lines, so that a discharge lamp and a control circuit are both supplied with the power when the respective switch means are switched on in synchronism with each other. Specifically, even if a failure occurs on a power supply path to a lighting circuit to interrupt the power supply to the lighting circuit, the operation of the control circuit is ensured as long as the power supply path to the control circuit is normal, thereby making it possible to detect a failure occurring in the discharge lamp or the lighting circuit by the control circuit to take safety measures such as lighting another light source as a substitute light source for the discharging lamp, alarming the occurrence of a failure, and so on.

However, since it is difficult to switch on/off the respective switch means provided on the respective power supply paths completely in synchronism with each other (specifically, a plurality of elements, even in the same specifications, cannot be switched on simultaneously at a correct timing due to a shift in on-timing caused by dimensional errors and variations in the manufacturing process of the switching means, and delayed operations due to response speeds of the switching elements), there is a problem in that the circuit is likely to suffer from malfunctions.

SUMMARY OF THE INVENTION

It is therefore an object of the present invention to take sufficient safety measures in a lighting circuit which comprises switching means provided on each of power supply paths such that power supplies can be received on two or more lines, and is configured to supply the power to a discharge lamp and a control circuit when the switch means are switched on substantially in synchronism with each other, by preventing malfunctions from occurring due to a shift in open/close timing of each switch means.

To achieve the above object, a discharge lamp lighting circuit comprises: a lighting circuit which receives a power supply from a power source and lights on a discharge lamp; a control circuit which detects a failure occurring in a discharge lamp or the lighting circuit so that the power supply to the discharge lamp or operation of the lighting circuit is stopped, and another light source as a substitute light source for the discharge light is lighted, or the occurrence of the failure is notified; at least two switching means, one being connected to said lighting circuit for receiving power supply, while the other being connected to said control circuit for receiving another power supply, the respective switches being switched on substantially in synchronism with one anther; wherein said control circuit is prohibited from stopping the power supply to the discharge lamp, or stopping the operation of the lighting circuit, or lighting the substitute light source, or notifying the occurrence of a failure until a predefined time period is elapsed from the time said switch means are switched on to cause the lighting circuit to start operating.

Therefore, according to the present invention, since the control circuit is prohibited from stopping the power supply to the discharge lamp or stopping the operation of the lighting circuit, or lighting the substitute light source, or notifying the occurrence of a failure until the predefined time period is elapsed after the lighting circuit has started the operation, it is possible to prevent malfunctions of the control circuit due to a shift in open/close timing of the switch means.

DETAILED DESCRIPTION OF THE PREFERRED EMBODIMENTS

Figure 1:
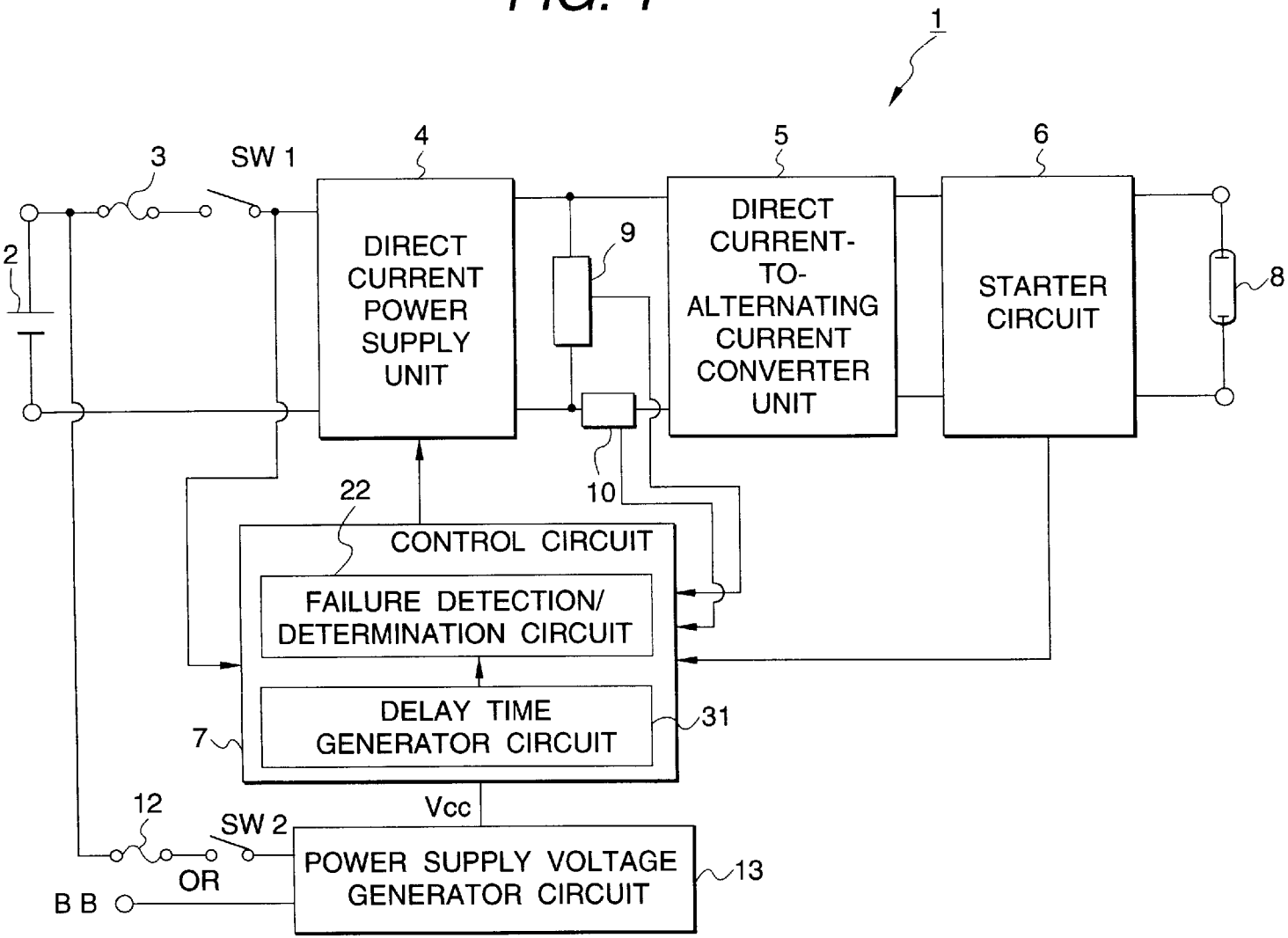
FIG. 1 a block diagram illustrating the basic configuration of a discharge lamp lighting circuit according to the present invention.

FIG. 1 illustrates the basic configuration of a discharge lamp lighting circuit 1 according to the present invention which comprises components listed below (parenthesized numbers indicate reference numerals).

a direct current power source (2);

an over-current protecting means (3);

a direct current power supply unit (4);

a direct current-to-alternating current converter unit (5);

a starter circuit (6); and a control circuit (7).

In the present circuit, the direct current power supply unit 4 is configured to receive a power supply from the direct current power source 2 through the over-current protecting means 3 and a switch means SW1. Specifically, when the switch means SW1 is switched on, a supply voltage is supplied to the direct current power supply unit 4 as an input voltage from the direct current power source 2 through the over-current protecting means 3 (for example, an over-current protecting element such as a fuse or a breaker). The direct current power supply unit 4 converts the input voltage to a desired direct current voltage in response to a signal from the control circuit 7 and outputs the desired voltage. For example, a DC-DC converter (of fly-back type, chopper type, or the like) having the configuration of a switching regulator may be used.

The direct current-to-alternating current converter unit 5, which is provided for converting an output voltage from the direct current power supply unit 4 to an alternating current voltage which is applied to a discharge lamp, may be configured, for example, in a bridge circuit using a plurality of pairs of semiconductor switching elements, a DC-AC converter using a converter transformer, and so on. However, as long as the present invention is concerned, the configuration may be of any type. Also, the waveform of an alternating current voltage supplied to the discharge lamp 8 may be any of a sinusoidal wave, a rectangular wave and so on.

The starter circuit 6 is provided for applying a high voltage pulse to the discharge lamp 8 to start the same. The pulse is generated at a predetermined timing from the time the discharge lamp is powered on, and multiplexed on an output voltage of the direct current-to-alternating current converter unit 5 and applied to the discharge lamp 8.

The control circuit 7 (in the configuration of FIG. 1, the circuit is powered through a switching means SW2, details of which will be described later) has one or both of functions set forth below:

(A) a function of detecting a voltage applied across the discharge lamp or a current flowing through the discharge lamp to control the power supplied to the discharge lamp, or to determine whether or not the discharge lamp fails in terms of a lighting condition; and (B) a function of detecting a voltage inputted to the direct current power supply unit to determined whether or not a failure has occurred in the input voltage.

Specifically, first, the function (A) is required to ensure that the discharge lamp 8 is normally powered. For example, when a PWM (pulse width modulation) scheme is employed for controlling a DC-DC converter which forms part of the direct current power supply unit 4, a control signal, the duty cycle of which varies in response to a signal indicative of a detected voltage or current of the discharge lamp 8, is generated and supplied to the DC-DC converter (a switching element contained therein) to control the output thereof.

The control circuit 7 is also responsible for detecting a failure in a lighting condition of the discharge lamp 8, for example, the discharge lamp 8 failing to light due to an excessive reduction in a current flowing into the discharge lamp 8, an over-current in the direct current power supply unit 4, the direct current-to-alternating current converter unit 5 failing to operate, and so on. In other words, the functionality of the control circuit 7 also includes processing involved in detection of a failure and determination of a failed condition.

For detecting a voltage across and a current through the discharge lamp 8, a voltage detector unit (a shunt resistor or the like) 9 and a current detector unit (a shunt resistor for voltage conversion, or the like) 10 may be provided at an output stage of the direct current power supply unit 4 to generate detecting signals.

The function (B) involves determining a failure in terms of an input voltage to the direct current power supply unit 4, for example, the magnitude of the input voltage reduced below an allowable range or, on the contrary, exceeding the allowable range, and so on, and is required to protect the discharge lamp and the lighting circuit from damages resulting from fluctuations in the power supply voltage.

When an excessive current flowing through the lighting circuit causes the over-current protecting means 3 to activate, the power is not supplied to the direct current power supply unit 4 and circuit subsequent thereto, as well as to the discharge lamp 8. For example, when a fuse is used as the over-current protecting means 3, the lighting circuit will not operate due to interruption of the direct current power supply inputted thereto in a situation in which an increasing direct current input current results in breaking the fuse (for example, a failure in the DC-DC converter, or the like).

However, in an application to an illumination system for vehicle, it is not a preferred selection to leave the foregoing condition, i.e., the discharge lamp 8 disabled to light, in view of the safety of a vehicle during its running. Desirably, appropriate steps should be taken, such as notifying a driver of some failure which has occurred in lighting of the discharge lamp 8, or lighting a substitute light source (or an auxiliary light source)

To do so, the power supply to the control circuit 7 must be ensured even when the over-current protecting means 3 acts, for example, in the following forms.

(I) A voltage drawn from a position close to the direct current power source before the over-current protecting means 3, or a voltage generated from this voltage is supplied to the control circuit as a power supply voltage.

(II) A voltage from a line different from the direct current power source 2, or a voltage generated from this voltage is supplied to the control circuit as a power supply voltage.

First, the form (I) may be implemented by supplying the direct current power supply unit 4 forming part of the lighting circuit with a supply voltage from the direct current power source through a first over-current protecting means 3, and supplying the control circuit 7 with the supply voltage through a second over-current protecting means from the direct current power source 2, or a voltage generated from this voltage, as a power supply voltage.

Figure 2:
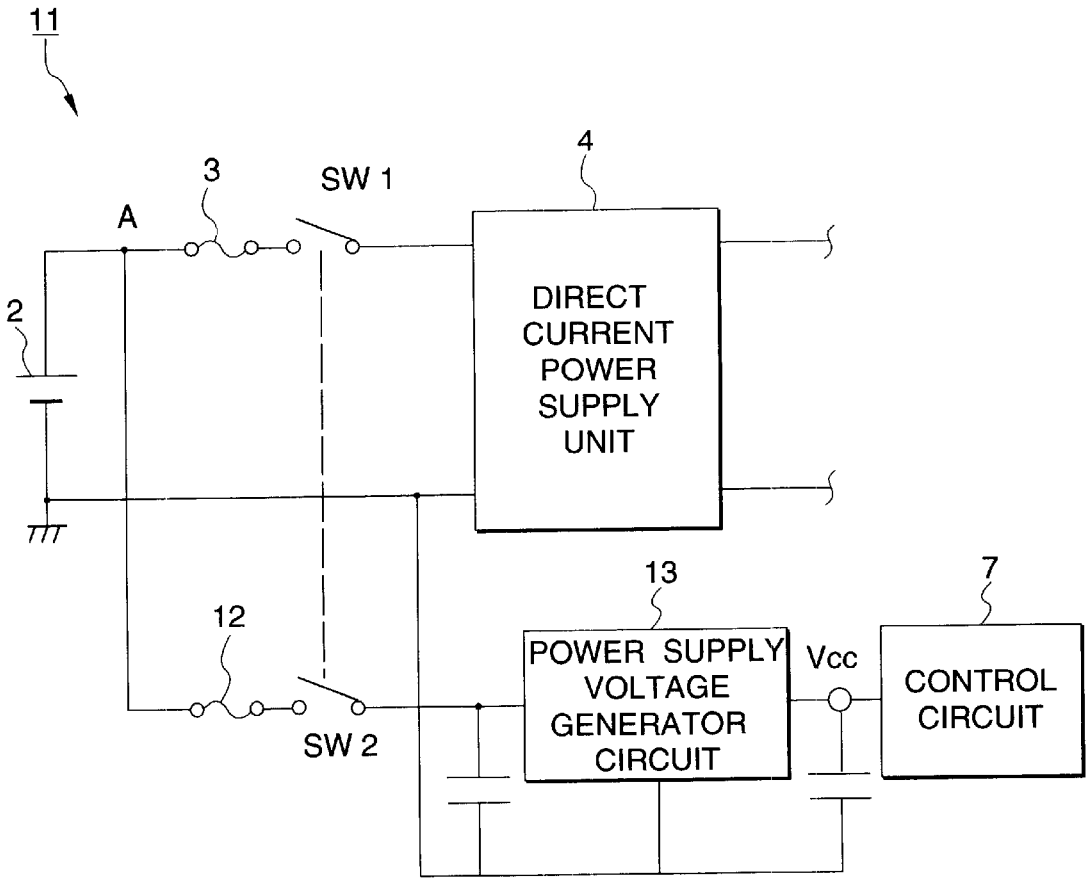
FIG. 2 is a diagram illustrating a main portion of a configuration for supplying a control circuit with a power supply voltage based on one of two voltages branched from a direct current power source.

FIG. 2 illustrates a main portion of an exemplary configuration 11 for the form as described above.

As illustrated, a power supply voltage from the direct current power source 2 is supplied to the direct current power supply unit 4 of the lighting circuit through the first over-current protecting means 3 and the switch element SW1, and the power supply voltage from the direct current power source 2 is supplied to a power supply voltage generator circuit 13 through a second over-current protecting means 12 and the switch element SW2 after it is branched at a branch point "A" (a connection point of the direct current power source 2 with the first over-current protecting means 3).

While the power supply voltage passing through the second over-current protecting means 12 and the switch element SW2 may be supplied directly to the control circuit 7, the illustrated example is configured to supply the control circuit 7 with a voltage generated by the power supply voltage generator circuit 13 (hereinafter called "Vcc"). Also, the first switch element SW1 disposed on the power supply path from the direct current power source 2 to the direct current power supply unit 4, and the switch element SW2 disposed on the power supply path to the control circuit 7 are adapted to be opened and closed in synchronism with each other. These switch elements are both closed when the discharge lamp 8 is lit.

The power supply voltage generator circuit 13 may be configured, for example, in the following manner, but is not limited to any particular configuration or method for generating a voltage:

a configuration using a three-terminal regulator;

a configuration using a series regulator; or a configuration using a switching regulator.

In the circuit configuration illustrated in FIG. 2, it can be seen that even if the first over-current protecting element 3 is fused out so that the direct current power supply unit 4 of the lighting circuit cannot be powered, the control circuit 7 is powered to ensure the operation of the control circuit 7 as long as the second over-current protecting element 12 is not broken.

The form (II) is intended to ensure the power supplied to the control circuit 7 even if the over-current protecting means 3 acts by supplying the control circuit 7 with a voltage on a line different from the direct current power source 2 for the lighting circuit or with a voltage generated from this voltage.

Figure 3:
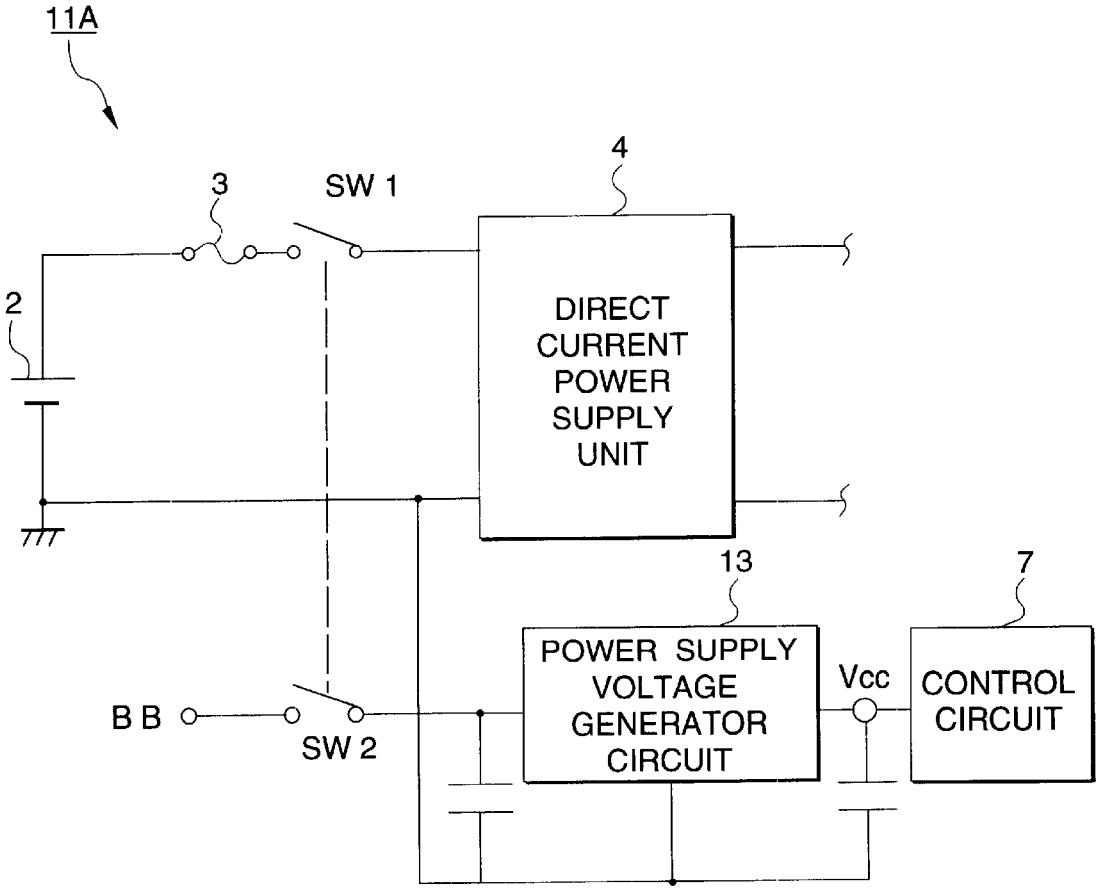
FIG. 3 is a diagram illustrating a main portion of a configuration for supplying the control circuit with a power supply voltage from a power supply of another line.

FIG. 3 illustrates a main portion of an exemplary configuration 11A for the form as described above.

As illustrated, the direct current power supply unit 4 of the lighting circuit is supplied with the power supply voltage from the direct current power source 2 through the over-current protecting means 3 and the switching element SW1, while the control circuit 7 is powered through a different power supply path from that for the lighting circuit.

Specifically, a power supply voltage from a different line (for example, an ignition voltage or the like is used in an automobile. In the following, this voltage is designated "BB") is supplied to the power supply voltage generator circuit 13 through the switch element SW2.

The first switch element SW1 and the second switch element SW2 are adapted to be opened and closed (or switched on/off) in synchronism with each other.

However, in this circuit, it can be seen that even if the over-current protecting means 3 acts so that the direct current power supply unit 4 of the light circuit cannot be powered, the operation of the control circuit 7 is ensured as long as the power supply voltage BB is supplied to the control circuit 7.

Figure 4:
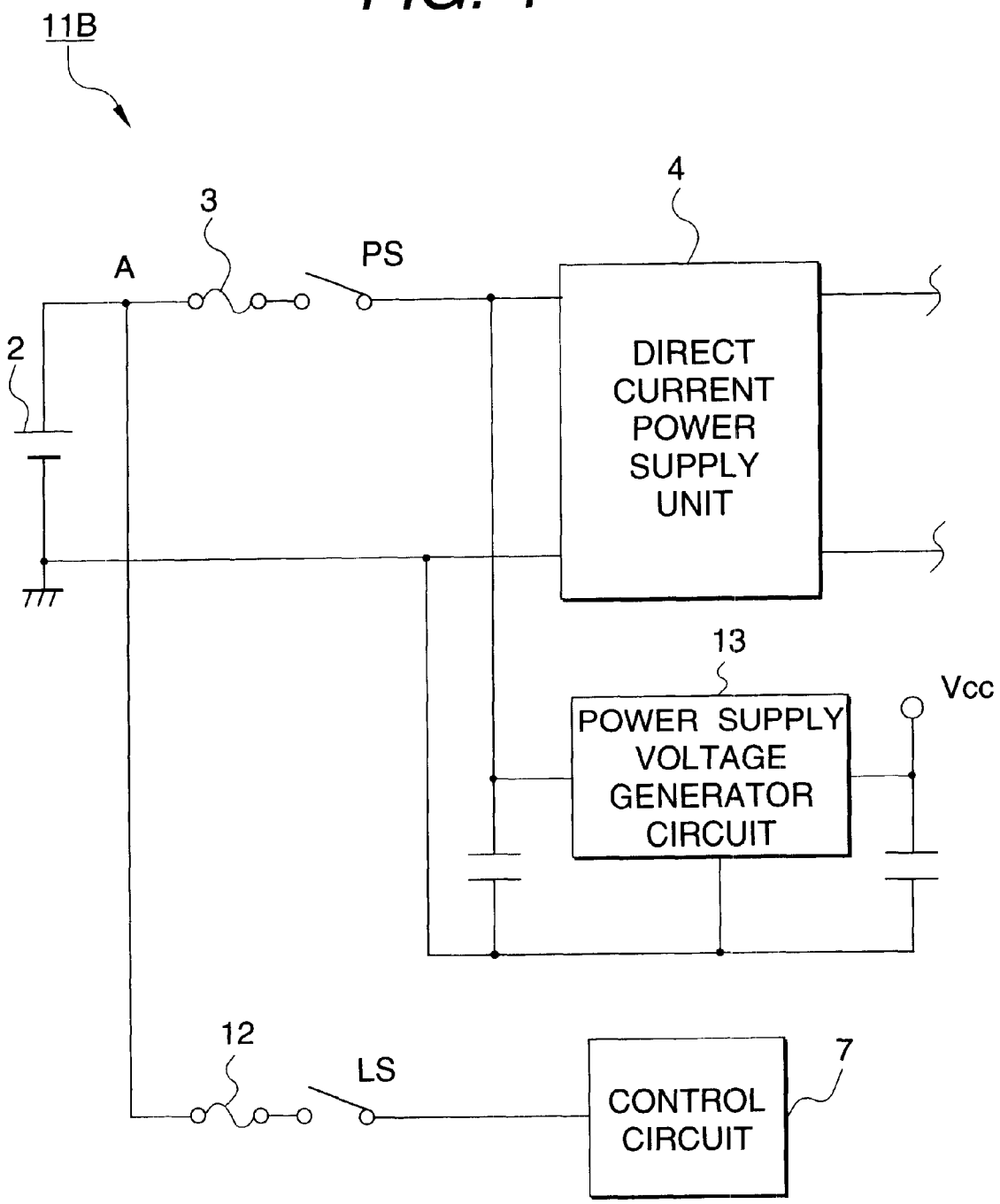
FIG. 4 is a diagram illustrating another exemplary configuration for supplying the power to a lighting circuit and the control circuit.
Figure 5:
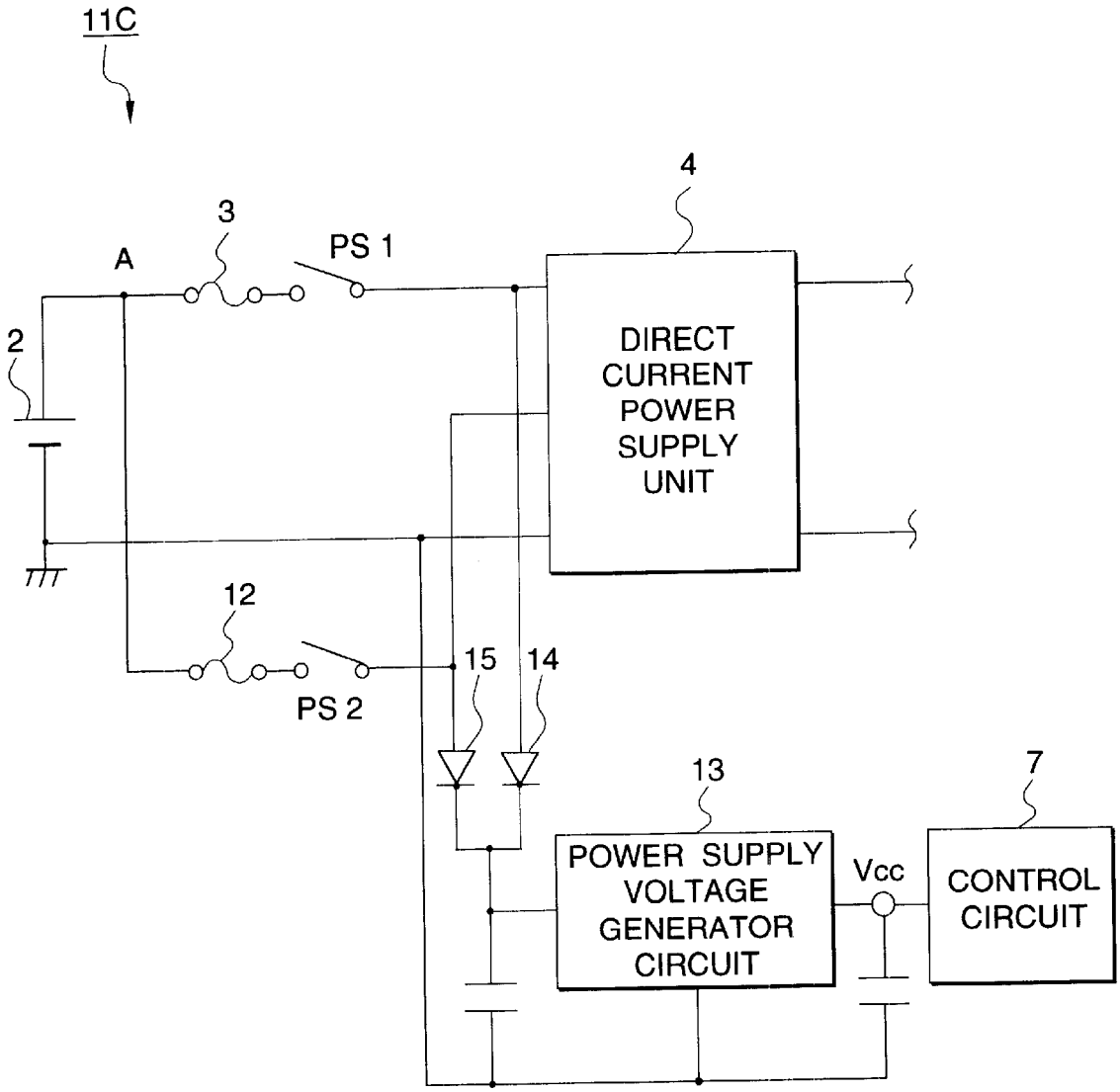
FIG. 5 is a diagram illustrating a further exemplary configuration for supplying the power to the lighting circuit and the control circuit.

Otherwise, exemplary configurations illustrated in FIGS. 4 and 5 are contemplated by way of example.

In FIG. 4, the power supply voltage from the direct current power source 2 is branched at a point A such that one of the branched power supply voltages is supplied to the direct current power supply unit 4 and the power supply voltage generator circuit 13 through the first over-current protecting means 3 and a power supply input switch "PS," while the other one of the branched power supply voltages is supplied to the control circuit 7 through the second over-current protecting means 12 and a light switch (lighting switch) "LS."

Then, one discharge lamp is lit when the power supply input switch PS is switched on, while the other discharge lamp is lit when the light switch LS is switched on. For example, for a vehicle, in an illumination system which uses discharge lamps for a running beam (so-called high beam) and a dipped beam (so-called low beam), the running beam may be lit by means of the light switch LS. Alternatively, in an illumination system which uses discharge lamps for left and right head lamps provided on a front face of a vehicle, the respective switches PS, LS maybe synchronized to define their on/off states. For lighting two discharge lamps with a common circuit, for example, voltages of positive polarity and negative polarity separately outputted from associated output terminals of the direct current power supply unit 4 are delivered to the direct current-to-alternating current converter unit 5. A bridge circuit using a plurality of switching elements are provided in the direct current-to-alternating current converter unit for switching these voltages, such that the respective switching elements are alternately operated by a driving circuit to supply the respective discharge lamps with an alternating current voltage generated thereby. In addition, a starter circuit may be provided separately for each discharge lamp such that one of the discharge lamps is started when the switch PS is switched on while the other discharge lamp is started when the switch LS is switched on. However, the present invention is not limited to any particular circuit configuration for implementing the form (II).

In the illustrated circuit, it can be seen that even if the first over-current protecting mean 3 acts so that the direct current power supply unit 4 of the lighting circuit cannot be powered, the operation of the control circuit 7 is ensured as long as the control circuit 7 is powered from the second over-current protecting means 12 through the switch LS.

In FIG. 5, a power supply voltage from the direct current power source 2 is branched at a point A, and one of the branched power supply voltages is supplied to the direct current power supply unit 4 through the first over-current protecting means 3 and a power supply input switch "PS1" and also supplied to the power supply voltage generator circuit 13 through a diode 14. Also, the other branched power supply voltage from the direct current power source 2 is supplied to the direct current power supply unit 4 through the second over-current protecting means 13 and a power supply input switch "PS2" and also supplied to the power supply voltage generator circuit 13 through a diode 15. In other words, in this example, the two diodes are connected to form an OR circuit, and the power supply voltage passing through this OR circuit is supplied to the power supply voltage generator circuit 13. The control circuit 7 is supplied with the predetermined voltage Vcc outputted from the power supply voltage generator circuit 13. When this circuit is applied to an illumination system for a vehicle, a lighting circuit may be provided separately for each discharge lamp, for example, in a system which uses discharge lamps for a running beam and a dipped beam, or a system which uses discharge lamps for left and right head lamps provided on a front face of the vehicle.

In this circuit, the power supply voltage generator circuit 13 and the control circuit 7, not to mention the direct current power supply unit 4, are powered as long as both the first and second over-current protecting means act so that no power supply can be received, so that the operation of the control circuit 7 is ensured.

While the foregoing description has been made for two power supply paths, it goes without saying that a variety of implementations maybe employed in consideration of convenience, such as the provision of three or more power supply paths.

In the respective circuits described above, the followings are measures preferably taken by the control circuit 7 for ensuring the safety of a vehicle during its running when the over-current protecting means 3 provided on the power supply path from the direct current power source 2 to the direct current power supply unit 4 act to break the power supply to the discharge lamp 8.

(i) A control signal is delivered to a lighting circuit for a substitute light source from the control circuit to light another light source as a substitution for a discharge lamp.

(ii) A signal is delivered from the control circuit to a display means to notify the driver of a failure which has occurred in lighting of the discharge lamp.

(iii) A combination of (i) and (ii).

First, the item (i) can ensure sufficient illumination light by immediately lighting another light source as a substitution for a discharge lamp when the discharge lamp no longer can be lit.

While a necessary number of additional light sources are preferably provided for respective discharge lamps as substitute light sources for the discharge lamps from a view point of safety running, problems are left unsolved in terms of cost and available space. Therefore, for example, discharge lamps may be used for a light source for head lamps (a light source for a running beam or a light source for a dipped beam), while a light source for auxiliary front illumination (fog lamps, clearance lamps, cornering lamps and so on) may be used as a substitute light source. Alternatively, with a light source for a running beam and a light source for a dipped beam which constitute light sources for head lamps, when a discharge lamp is used for one of them, the other light source may be used as a substitute light source.

The item (ii) can draw the driver's attention by notifying through a display means (an indicator or the like) that a discharge lamp no longer can be lit. In other words, when a discharge lamp no longer can be lit, the driver of the vehicle should be prompted to replace the failed discharge lamp or repair the lighting circuit by notifying the driver of the occurrence of a failure.

Figure 6:
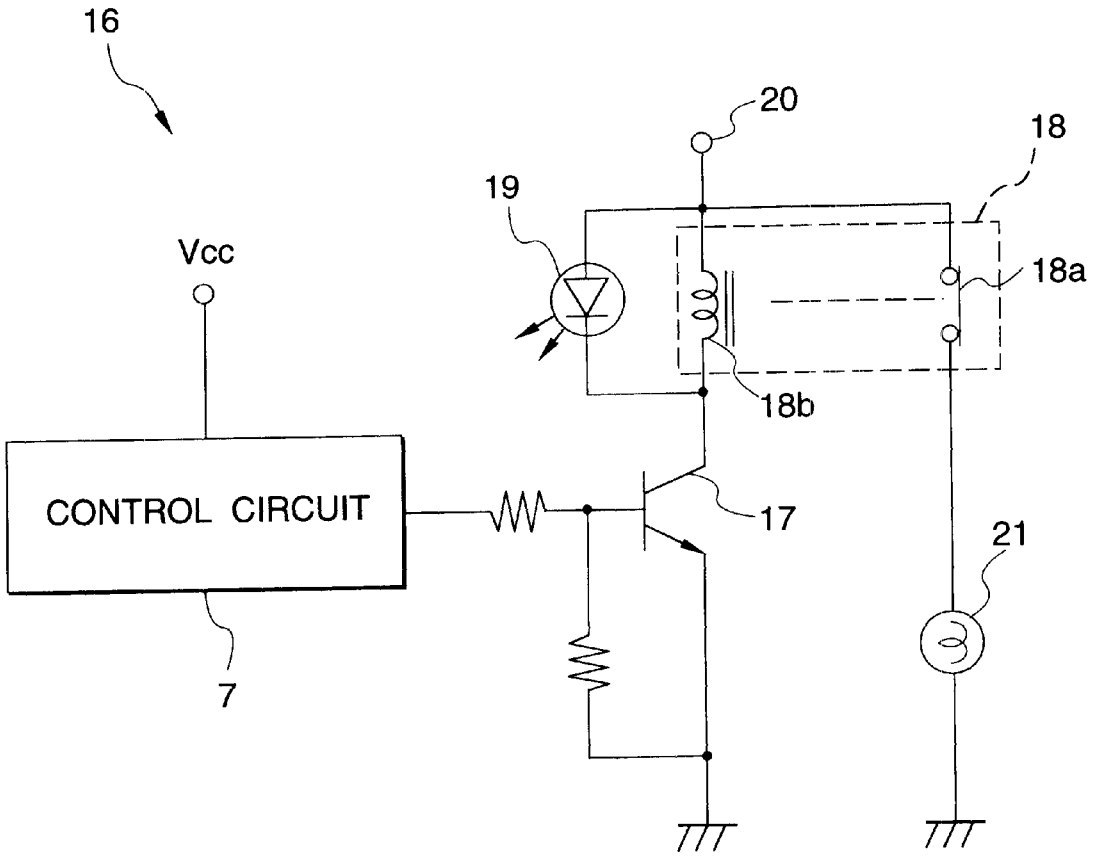
FIG. 6 is a diagram illustrating an exemplary configuration for lighting of a substitute light source and notification by means of a light emitting element.

FIG. 6 illustrates an exemplary circuit configuration 16 for lighting a substitute light source when a discharge lamp no longer can be lit.

When the control circuit 7 detects a lighting disabled state of the discharge lamp 8, an NPN transistor 17 is turned on by an output signal from the control circuit 7. The transistor has a collector connected to a coil 18*b* of a relay 18 for lighting a substitute light source, and a light emitting element (for example, a light emitting diode, a lamp, or the like). These elements are connected in parallel with each other and supplied with a predetermined voltage (which is a voltage on a line different from the supply voltage to the direct current power supply unit 4. For example, the voltage inputted to the power supply voltage generator circuit 13 in FIG. 2, or the like) from a power supply terminal 20, so that the substitute light source 21 is lit and the light emitting element 19 is simultaneously illuminated when the transistor 17 is turned on to activate the relay 18 to close its contact 18*a*. Since the light emitting element 19 serves as an indicator for notifying the driver of a failure in the lamp, the driver can immediately recognize that the occurrence of a failure has caused the substitute light source 21 to light on when he notices the lighting indicator.

The lighting disabled state of a discharge lamp may be detected by monitoring the values of a voltage across the discharge lamp and a current through the same to check whether or not these values are within allowable ranges, by detecting a failure in operation of a circuit, by determining whether or not a direct current input voltage is within an allowable range through a comparison with a threshold, and so on. Since these methods are well known and the present invention is not limited to any detecting method, detailed description thereon is omitted.

Also, while in the configuration illustrated in FIG. 6, the relay coil and the light emitting element are driven by the single transistor, a separate driving transistor may be provided for each of them, or alternatively, a variety of implementations are possible such as a combination of a circuit for blinking the light emitting element, a alarm generator circuit and so on.

The combination of the items (i) and (ii), shown above in the item(iii), may cause the driver to experience more difficulties in noting the occurrence of a failure if a substitute light source is lit immediately after a discharge lamp fails. As a consequence, if the driver neglects measures such as repair and replacement, the following concerns are expected.

Since any alternative illuminating means is not available if the substitute light source fails to light, the driver is forced to run in the dark at night, resulting in a dangerous situation.

If a failure is left unrecognized for a long term, a problem arises in an increase in load on the power supply resulting from useless power consumption, danger of electric shock, and so on.

Thus, the notification to the driver set forth in the item (ii) increases its effectiveness on condition that the item (i) is employed together.

As previously described, it is difficult to provide a switch means separately for each of two or more power supply paths and switch on/off these switch means completely in synchronism with one another. The difficulties may result from a shift in on-timing due to a manufacturing error of switch means, an operational delay due to a response speed of switch means (for example, a relay), chattering, and so on.

As an inconvenience caused by a shift in timing at which a switch means is switched on, the occurrence of a failure is erroneously determined, for example, due to an erroneous detection even though the operation of the lighting circuit is normal.

For example, assume in the circuit configurations illustrated in FIGS. 2 and 3 that the second switch element SW2 is switched on instantaneously earlier than the first switch element SW1. The switch element SW2 thus switched on causes the control circuit 7 to start operating and, for example, drive the direct current-to-alternating current converter unit 5 to power the discharge light 8. However, the control circuit 7 simultaneously monitor the state of the discharge light from its voltage and current to start detecting whether or not any failure is present. For example, if a time measuring circuit (timer or the like) is provided for determining a failure, the control circuit 7 determines that a failure has certainly occurred if the failure has continued for a predefined time period or more.

Upon detection of a failure, if SW1 is not switched on, the direct current power supply unit 4 cannot be powered, so that the discharge lamp cannot be lit, and accordingly no current flows therethrough. When the control circuit 7 determines this state as a failure, the control circuit 7 will stop the operation of the lighting circuit or light a substitute light source as mentioned above to take countermeasures to the occurrence of the failure. In other words, a failure is determined only by a simple delay of the switch means to possibly disable the discharge lamp to light or light the substitute light source.

Figure 7:
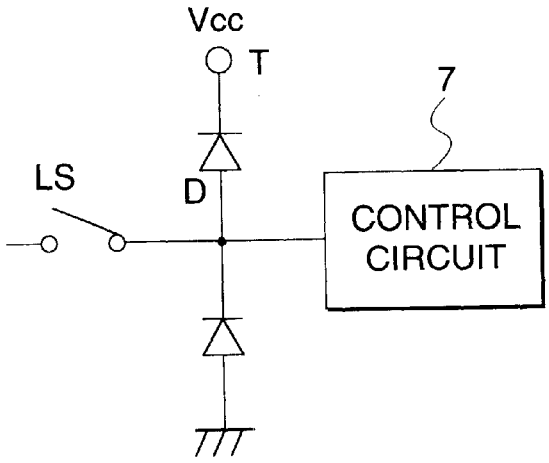
FIG. 7 is an explanatory diagram about a power supply inputted from a switch to the control circuit.

Also, in the circuit configuration illustrated in FIG. 4, assuming that the switch LS is switched on prior to the switch PS, if a circuit which receives an input of the switch LS has a low impedance as illustrated in FIG. 7, the control circuit 7 is likely to start operating by a voltage which may be introduced from a electrostatic protecting diode D at an input stage into the power supply terminal T. If the control circuit 7 actually starts operating, a shift in on-timing of the switch PS will result in a problem similar to the foregoing. While a resistor may be inserted for receiving the input of the switch LS with a high impedance, the possibility of erroneous detection still remains since the occurrence of the aforementioned state is determined depending on the relationship between the value of consumed current associated with Vcc and the resistance of the inserted resistor.

In the configuration illustrated in FIG. 5, assuming that one of the switches PS1, PS2 is switched on earlier, the voltage Vcc rises in synchronism with the timing of the switch which is switched on earlier since the voltage Vcc is generated from a voltage through the diode 14 or 15 in an OR connection. Therefore, a similar problem arises for a power supply input from the switch which is switched on later. It should be noted that even when the OR connection of the diodes is not employed and Vcc is generated from power supply inputs received from two lines, the erroneous detection caused by a shift in synchronization of the switches is still problematic.

What is common to the foregoing situations is that it is not preferable to receive power supply inputs through the switches PS and LS before the voltage Vcc rises. This would result in a very unstable state. Therefore, for receiving power supply inputs from two or more lines, the lighting circuit should be designed such that Vcc first rises without fail, in which case, however, the control circuit 7 is likely to erroneously determine the occurrence of a failure due to a delay in switching on the other switch.

To prevent the inconveniences described above, the present invention prevents erroneous detection by prohibiting any or both of the following items performed by the control circuit 7 for a predefined time period from the time the switch means is switched on to start operating the lighting circuit.

(A) Stop supplying the power to the discharge lamp, or stop operating the lighting circuit.

(B) Light a substitute light source, or notify the occurrence of a failure.

Specifically, (A) is a protective operation required for protecting the discharge lamp and circuit from a failure, while (B) is an auxiliary operation for follow-up when the discharge lamp ends up in failing to light for some reason.

For detecting a failure in the discharge lamp or the lighting circuit, it is desirable to ensure the certainty of the determination result by providing a time measuring circuit for measuring a time period elapsed from the time the occurrence of the failure has been detected, such that no failure is determined until a predefined time period (which is a determination time, the length of which indicates a threshold) is elapsed. Specifically, the time measuring circuit is required to determine the presence or absence of a failure based on the fact that the failure is not transient or temporary but is continuing for the predetermined time period or more, such that the control circuit is prevented from determining a failure as long as a time period measured by the time measuring circuit is shorter than the predefined time.

Figure 8:
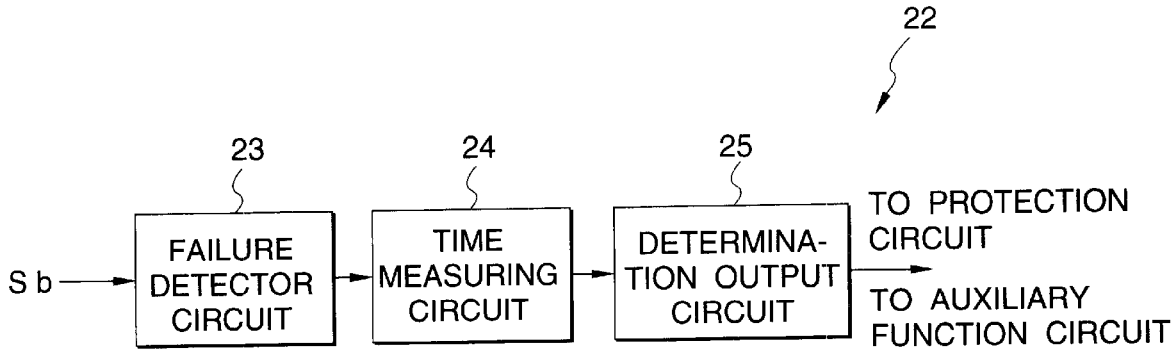
FIG. 8 is a block diagram illustrating the basic configuration of a failure detection and determination circuit.

FIG. 8 illustrates the basic configuration of a failure detection/determination circuit 22 which comprises the following components (parenthesized numbers indicate reference numerals):

a failure detector circuit (23);

a time measuring circuit (24); and a determination output circuit (25)

While failures may be caused by a variety of factors, for example, a discharge lamp which comes off (an output open state of the lighting circuit), short-circuiting of electrodes, failures associated with an input voltage to the lighting circuit (over-voltage and reduced voltage), and so on, a source signal or a primary signal (hereinafter labeled "Sb") is required for detecting any of these failures. The signal Sb is sent to the failure detector circuit 23.

The failure detector circuit 23 outputs a detecting signal (or a state signal) indicative of a high probability of some failure based on the signal Sb, and delivers the detecting signal to the subsequent time measuring circuit 24. Specifically, since immediate determination of the occurrence of a failure at this time is too early, it is determined by the time measuring circuit 24 whether this state has continued for a predefined time period.

The time measuring circuit 24, which comprises a timer, a counter or the like, starts a time measuring operation in response to an output signal from the failure detector circuit 23, and sends a signal indicative of a determination result that a failure has occurred to the determination output circuit 25 when the failure has continued for the predefined time period.

In this way, the determination output circuit 25 delivers to a protection circuit (including a fail-safe circuit and so on) and auxiliary function circuits (including for example, the aforementioned lighting circuit for a substitute light source, circuit for notification, and so on) a control signal indicative of the presence or absence of a failure and contents of instructions suitable for solving the failure. The protection circuit may be configured, for example, to dispose a relay contact on a power supply path to the direct current power supply unit to break the power supply from the direct current power source to the direct current power supply unit upon occurrence of a failure, to stop driving the bridge circuit in the direct current-to-alternate current converter unit, or in a variety of previously known forms, and the present invention is not limited to any configuration or method associated with the protection circuit, so that description thereon is omitted. Likewise, description on the auxiliary function circuits is also omitted for a similar reason.

Figure 9:
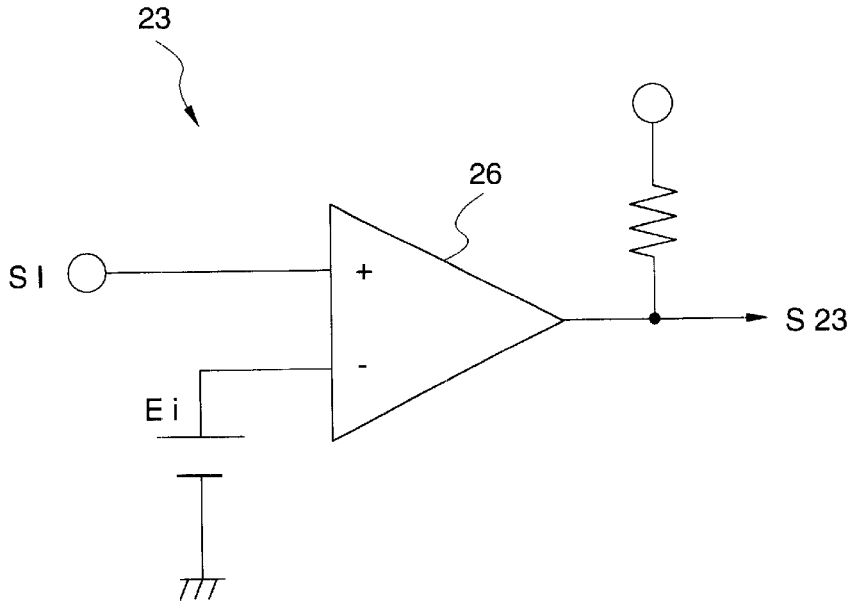
FIG. 9 is a diagram illustrating an exemplary configuration of a failure detector circuit.

FIG. 9 illustrates an exemplary configuration of the failure detector circuit 23.

For detecting a failure, a detector circuit is generally provided for each of various items to be detected. However, since it takes an excessive time to describe all of them, description will be herein made on detection of a failure associated with an (output) open state as a representative example.

As illustrated, in the failure detector circuit 23, a current detecting signal "S1" of the discharge lamp 8 is supplied to a positive input terminal of a comparator 26, while a reference voltage "Ei" (indicated by a symbol representative of a regulated voltage source in the figure) is supplied to a negative input terminal of the comparator 26. In other words, since no current flows into the discharge lamp 8 in an open state, the level of the current detecting signal SI (signal generated by converting a detected current to a voltage) is lower than the reference voltage Ei, causing the comparator 26 to output an L (low) level signal.

As in this example, any other failure may be detected by comparing the level of an associated detecting signal with a predefined threshold. However, for detecting a change in repetitions of a voltage or a current, certain techniques may be required such as designing a detector circuit in combination of a plurality of comparator.

Figure 10:
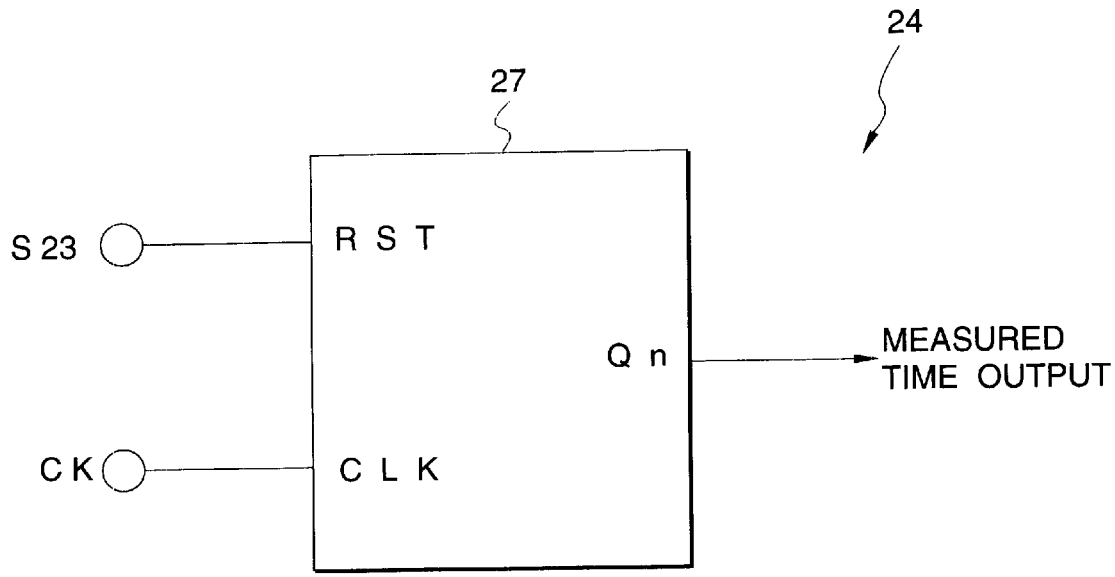
FIG. 10 is a diagram illustrating an exemplary configuration of a time measuring circuit.

FIG. 10 illustrates an exemplary configuration of the time measuring circuit 24.

While the time measuring circuit 24 may use a time constant circuit (CR circuit) as an analog timer, this example shows one which uses a counter 27.

The counter 27 is supplied at its reset terminal (RST) with a signal (labeled "S23") from the failure detector circuit 23, and at a clock signal input terminal (CLK) with a clock signal "SK" from a clock signal generator circuit, not shown.

A signal indicative of a failure determination result is outputted from an n-th output terminal "Qn" of the counter 27. This signal is generated when the signal S23 is at L level and the clock signal has been counted a predetermined number of times. In other words, since it is assumed that a failured state is indicated when the signal S23 is at L level, an H (high) level signal is outputted from the output terminal Qn of the counter 27 when the state lasts for a predetermined time period or more.

Figure 11:
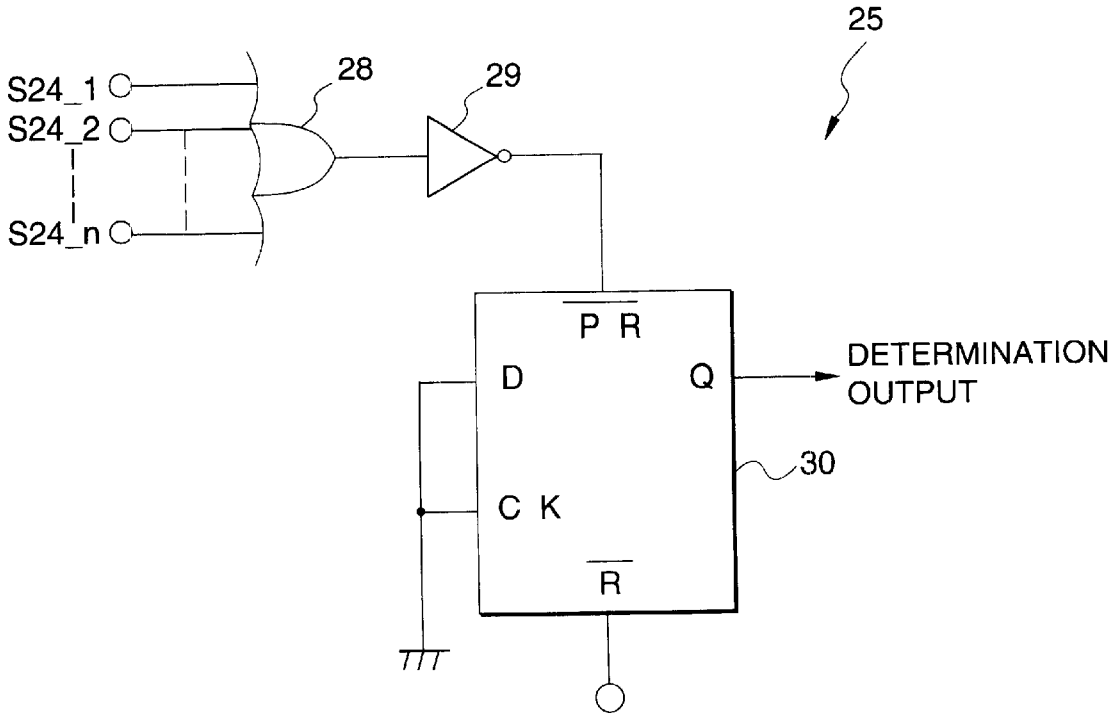
FIG. 11 is a diagram illustrating an exemplary configuration of a determination output circuit.

FIG. 11 illustrates an exemplary configuration of the determination output circuit 25 which is configured, in this example, to combine determination results generated from a plurality of time measuring circuits (though not shown, the circuit illustrated in FIG. 10 is provided for each of various failure detecting signals) into one by an OR (logical OR) circuit, and supply the resulting signal to a latch circuit.

Each of signals "S$24_{13}$ i" (i=1, 2, . . . ), which is a signal indicative of a result of determination made by a time measuring circuit provided for determining each of various failures, is inputted to a multi-input/single-output OR gate 28, the output signal of which is supplied to a preset terminal (since this is an L-active input, this terminal is labeled "PR" with a bar symbol "-" placed above in the figure) of a D flip-flop 30 through a NOT (logical negate) gate 29. A D-input terminal and a clock signal input terminal (CLK) of the D flip-flop 30 are at L level, while an L-active reset terminal (labeled "R" with a bar symbol "-" placed above) is at H level.

Therefore, if any of the signals S24_i (i=1, 2, . . . ) transitions to H level, the output of the OR gate 28 transitions to H level which is inverted by the NOT gate 29 and sent to the preset terminal of the D flip-flop 30, resulting in an H level signal generated at a Q-output terminal of the D flip flop 30. Since this H level signal is maintained, the Q-output terminal still remains at H level even if the signal S$24_{13}$ i subsequently returns to indicate a normal level (i.e., at H level). Then, this signal output is delivered, for example, to a protection circuit (not shown) for stopping the operation of the direct current power supply unit 4 or the direct current-to-alternating current converter unit 5, or delivered to the transistor 17 shown in FIG. 6 for use in lighting a substitute light source.

Next, description will be made on the configuration for prohibiting the aforementioned items (A), (B) while a time period measured by the time measuring circuit is shorter than the predefined time period.

Figure 12:
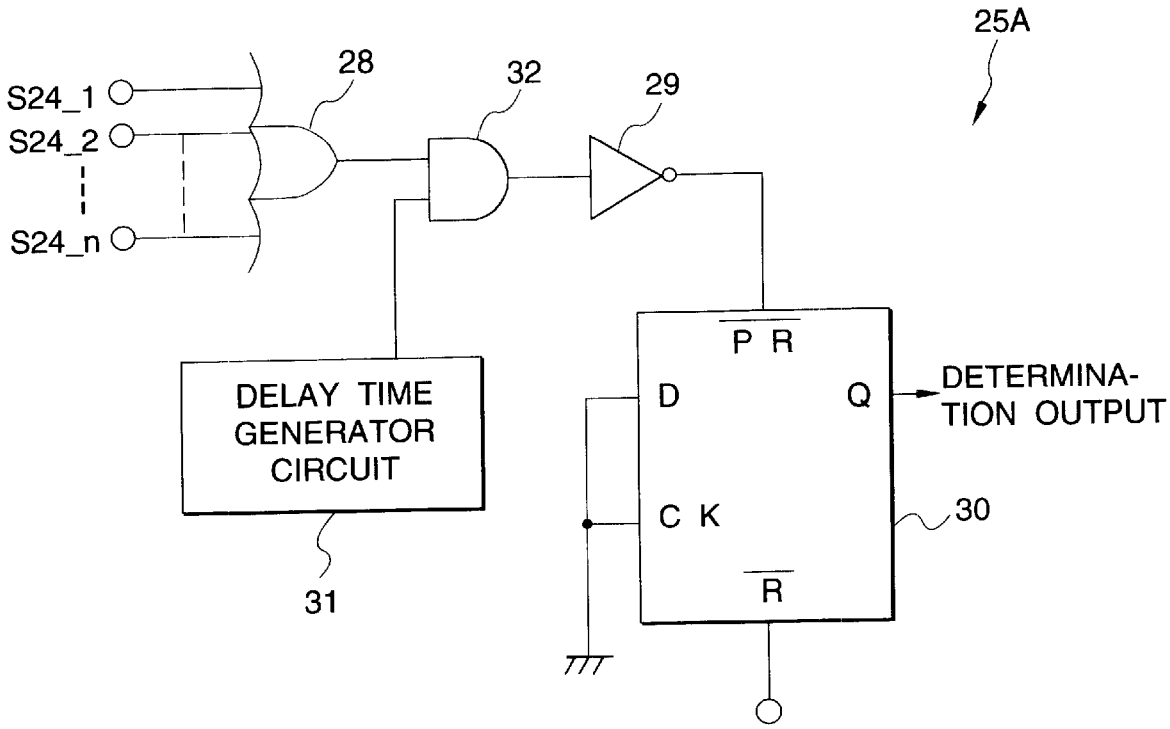
FIG. 12 is a diagram illustrating an example of the configuration of a determination output circuit according to the present invention.

FIG. 12 illustrates an exemplary configuration 25A (determination output circuit) for this purpose.

As can be seen from the figure, this configuration differs from the configuration illustrated in FIG. 11 in the followings.

A delay time generator circuit 31 is provided.

An two-input AND (logical AND) gate 32 is disposed between the multi-input OR gate 28 and the NOT gate 29. The gate is supplied with an output signal of the OR gate 28 at one input terminal, and with an output signal of the delay time generator circuit 31 at the other input terminal.

Figure 13:
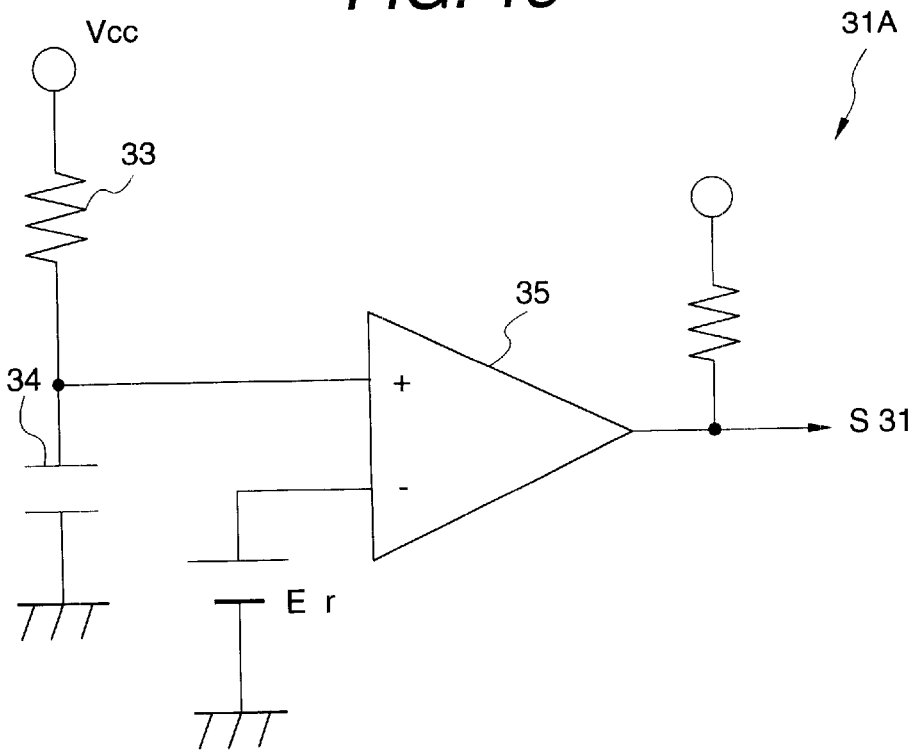
FIG. 13 is a diagram illustrating an example of a delay time generator circuit.
Figure 14:
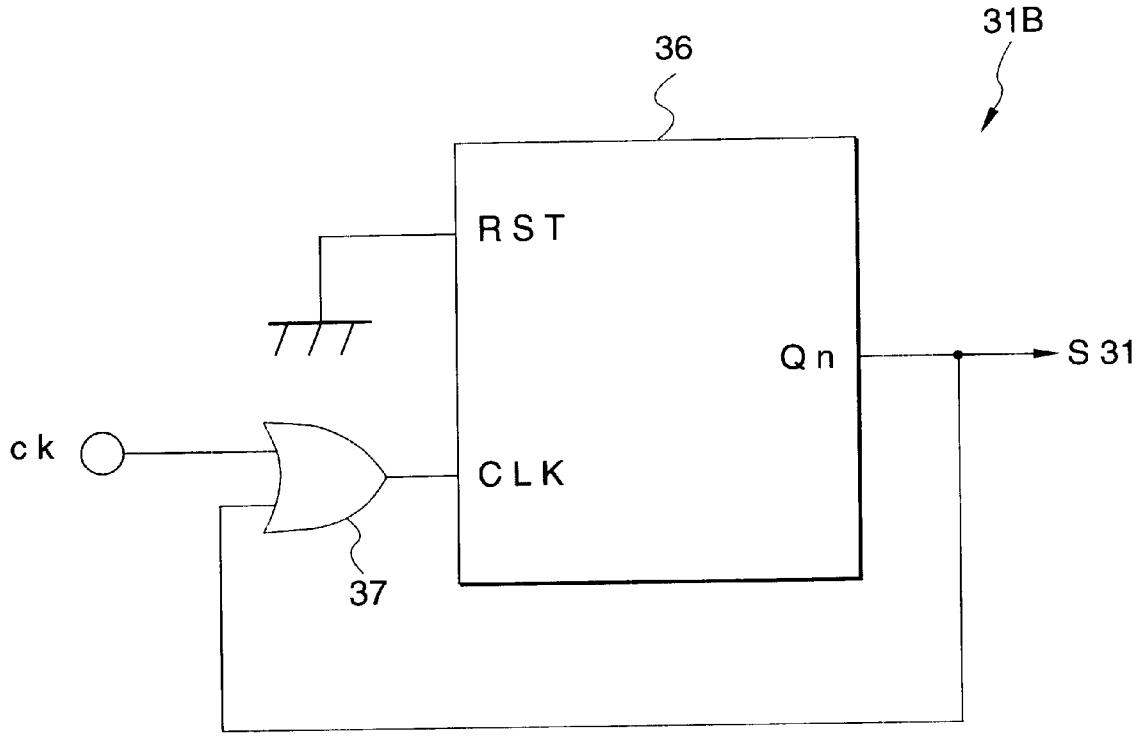
FIG. 14 is a diagram illustrating another example of the delay time generator circuit.

FIGS. 13 and 14 illustrate exemplary configurations of the delay time generator circuit 31.

In an exemplary configuration 31A illustrated in FIG. 13, a capacitor 34 is charged by a power supply voltage Vcc through a resistor 33, and its terminal voltage is sent to a positive input terminal of a comparator 35. This input voltage is compared with a reference voltage "Er" supplied to a negative input terminal. The comparator 35 outputs an L-level signal when the level of the positive input voltage is lower than Er, while the comparator 35 outputs an H-level signal when the level of the positive input voltage becomes higher than Er.

The exemplary configuration 31B illustrated in FIG. 14 uses a counter 36 which is supplied at its clock signal input terminal (CLK) with a predetermined clock signal "ck" through a two-input OR gate 37. A reset terminal "RST" of the counter is st at L-level, and an output signal generated from its output terminal "Qn" is sent to the remaining input terminal of the two-input OR gate 37. Therefore, as the counter 36 has counted a predetermined number of clock signals after Vcc rises, the output terminal Qn transitions to H level which is sent to the OR gate 28, so that the counter 36 will not subsequently receive the clock signal ck.

Thus, in the respective circuits described above, until a predetermined delay time is elapsed after the voltage Vcc has risen, the output signal (labeled "S31") of the delay time generator circuit 31 remains at L level and is sent to the AND gate 32 in FIG. 12, so that a signal outputted from the AND gate and passing through the NOT gate 29 is at H level, so that the Q-output of the D flip flop 30 is at L level. Subsequently, when the output signal "S31" of the delay time generator circuit 31 transitions to H level with the output signal of the OR gate 28 being at H level at this time, the signal outputted from the AND gate 32 and passing through the NOT gate 29 is now at L level to preset the D flip-flop 30, so that its Q-output is at H level.

In an actual circuit, when Vcc rises, initial setting signals (a pulse-on clear signal, a power-on reset signal, and so on) are generated to define the flip-flop, counter, time constant circuit and so on in initial states. Since the configurations and functions of the circuits associated therewith are well known, description thereon is omitted.

Figure 15:
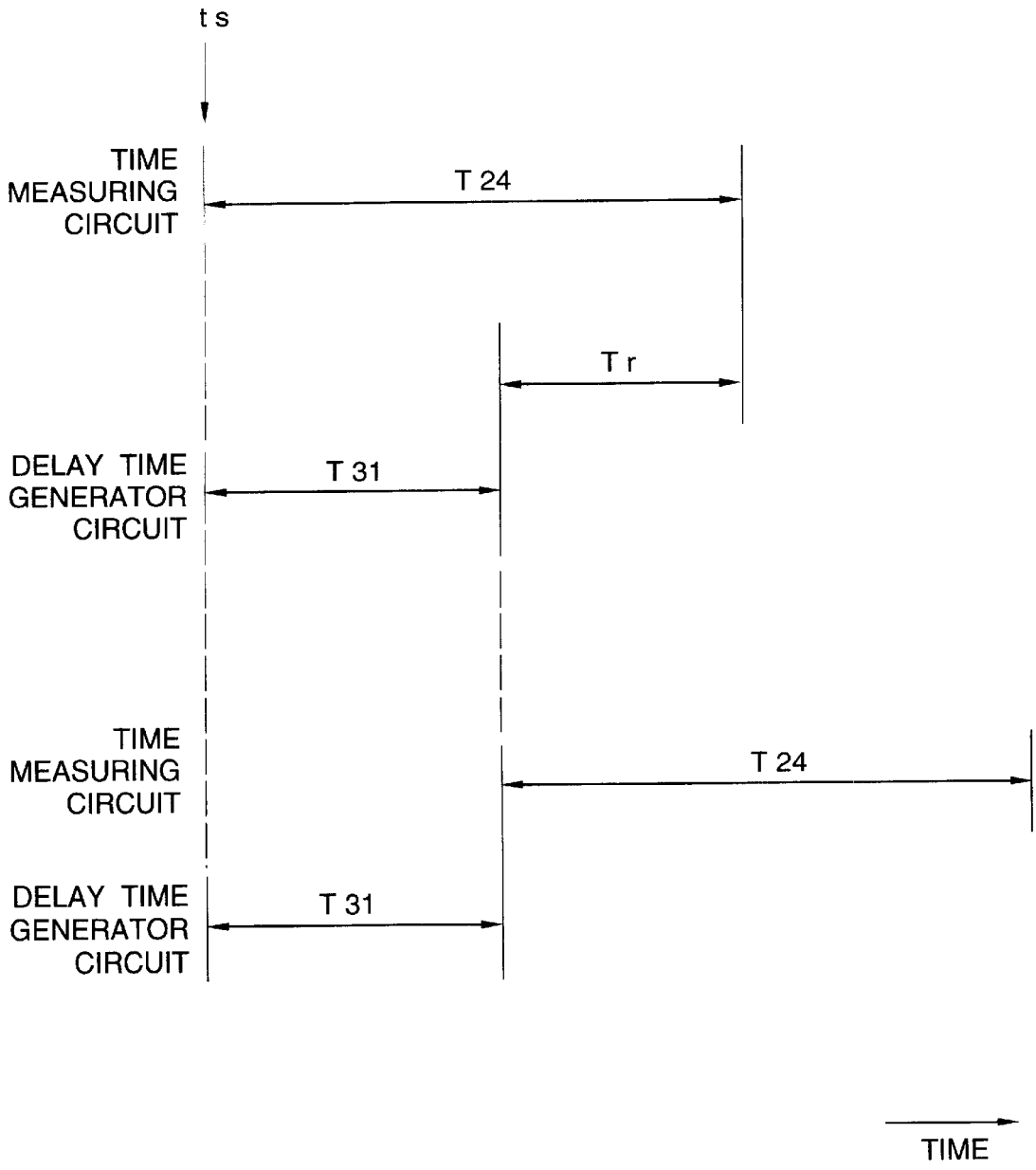
FIG. 15 is a diagram for explaining the operation during failure detection and determination.

FIG. 15 is a diagram for explaining a failure detecting operation after a switch means is switched on, wherein respective symbols have the following meanings.

An arrow "ts"=a time at which switch means are switch on substantially in synchronism with one another.

A period "T24"=a period in which the time measuring circuit 24 operates.

A period "T31"=a period in which the delay time generator circuit 31 operates (in other words, a period in which the circuit is outputting L level, which corresponds to a period in which the aforementioned items (A) and (B) are prohibited. These periods should be determined in conformity to the specifications or with reference to results of experiments, taking into consideration a response time, a time difference due to chattering as well as the type and form of the switching means).

As shown in an upper stage of the figure, the starting points of the period T23 and the period T31 are both at a time indicated by the arrow ts, and the length of the period T31 is set shorter than that of the period T24. Since the aforementioned items (A) and (B) are prohibited during the period T31 within the period T24, a time required to actually determine a failure is a residual period "Tr" which is the result of subtracting the period T31 from the period T24.

For preventing the period T31 from invading the time period available for determining a failure, as shown in a lower stage of the figure, the operation of the time measuring circuit 24 may be started after the period T31 is elapsed, so that the period T24 is completed.

In other words, the time measuring circuit 24 for determining whether a failure has occurred is configured such that its time measuring operation is started with a delay defined by the delay time generator circuit 31.

Figure 16:
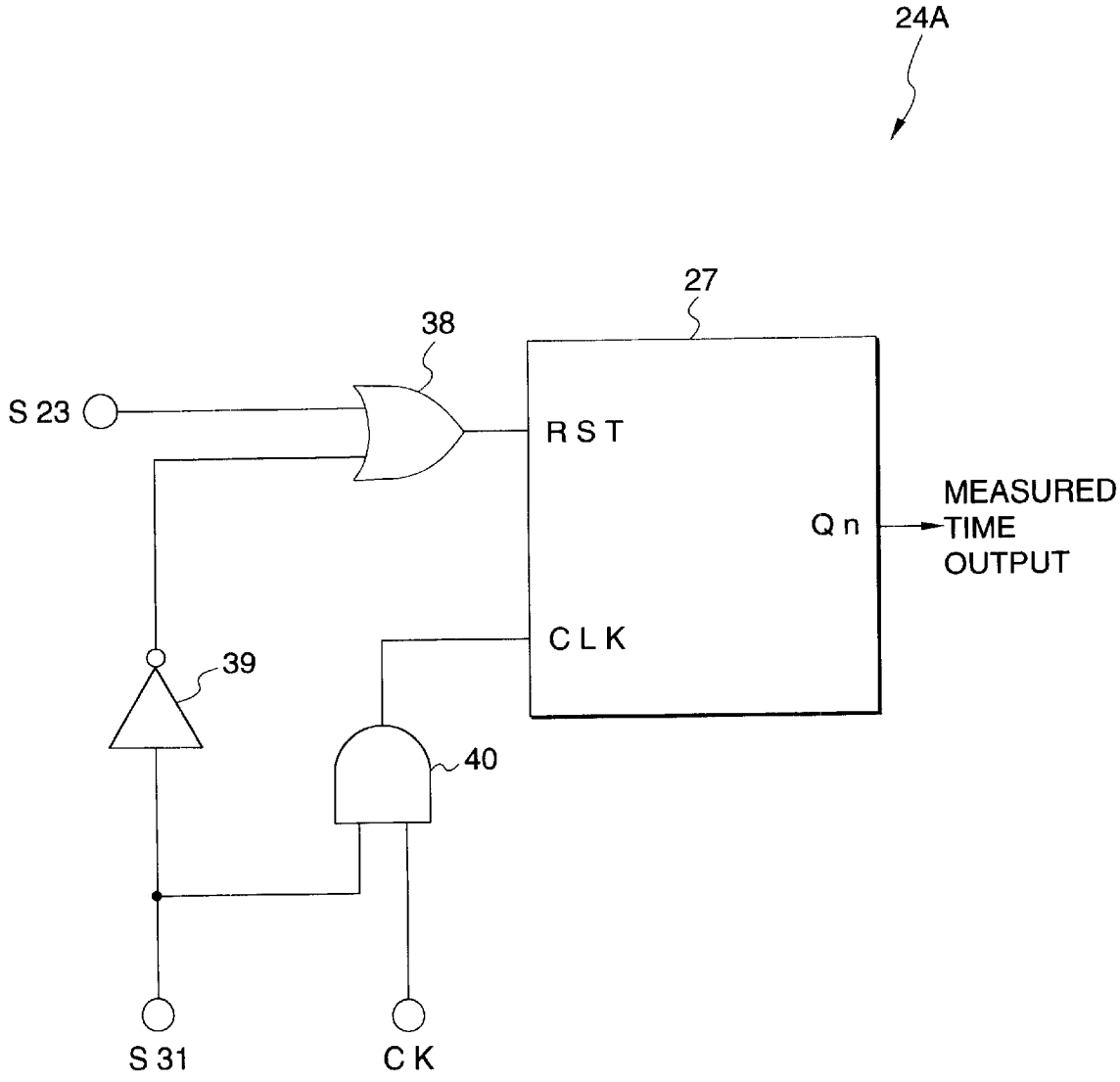
FIG. 16 is a diagram illustrating another example of the time measuring circuit.

FIG. 16 illustrates an exemplary circuit configuration 24A (a time measuring circuit) for this purpose.

The detecting signal "S23" (indicating a failured state when it is at L level) from the failure detector circuit 23 is supplied to one input terminal of a two-input OR gate 38, the other input terminal of which is supplied with the output signal "S31" from the delay time generator circuit 31 through a NOT gate 39.

An output signal of the OR gate 38 is sent to a reset terminal (RST) of the counter 27, which forms part of the time measuring circuit. The counter 27 is supplied at its clock signal input terminal (CLK) with a logically ANDed signal of the output signal S31 of the delay time generator circuit 31 and the clock signal CK, which is generated by a two-input AND gate 40. A signal generated from an output terminal "Qn" of the counter 27 is delivered to the determination output circuit 25.

In the circuit 24A, the signal S31 remains at L level while the period T31 is elapsed, so that the counter 27 is reset as a result of a negative version of the signal S31 delivered to the OR gate 38. In this event, an output signal of the AND gate 40 is at L level.

Then, as the signal S31 transitions to H level after the lapse of the period T31, the signal S23 is supplied to the reset terminal (RST) of the counter 27, as it is, through the OR gate 38, and the clock signal CK is supplied to the clock input signal terminal (CLK) of the counter 27 through the AND gate 40. In other words, this state is completely the same as the configuration illustrated in FIG. 10, so that the clock signal is counted when the detecting signal S23 is at L level.

Otherwise, a variety of implementations are contemplated such as a method of forcing the signal S23 to H level during the period T31, a method of prohibiting the clock signal from being inputted to the counter 27 during the period T31, and so on. In essence, timings may be set such that the period T24 is elapsed subsequent to the period T31 to prevent the period T31 from invading the period T24.

While the period (T31) in which the aforementioned items (A), (B) are prohibited has been described as applied to detection and determination of various failured states, it is preferred that the prohibition is not always applied but is limited only when the control circuit detects that a failure has occurred in an input voltage to the lighting circuit or the control circuit. The reason for this limitation will be described below in detail.

For example, if a large current flows due to short-circuiting or the like in a circuit, this situation should be prevented from lasting for a long time since the large current would cause abnormal heat generation, fuming and firing of circuit components, and damages to human bodies due to a high voltage. Assuming that the period T24 for determining short-circuiting is set to 100 milliseconds and the period T31 is set to 500 milliseconds, the operation of the lighting circuit is not stopped before a period of 600 milliseconds is elapsed in the method shown in the lower stage of FIG. 15, so that the short-circuiting lasts all the while.

Thus, to prevent an evil influence caused by a longer time taken until a failure determination result is provided, due to the addition of the period T31, the period T31 should be eliminated in the determination of a failure (or the period T31 is set to zero).

However, during a period in which a switching means is delayed to switch on, the input voltage to the lighting circuit is zero volt, so that an erroneous detection as described above would be made if the lighting circuit is left applied with zero volt. In this situation, therefore, the period T31 should be positively included for determining an abnormally low input voltage.

Apparently, a circuit configuration for this purpose can be provided by replacing several components in the circuits previously described. For example, the signal SI shown in FIG. 9 is regarded as a detecting signal indicative of an input voltage to the direct current power supply unit 4, and the reference voltage Ei as a threshold for the input signal (corresponding to a lower limit value of the input voltage). These signals may be delivered to the OR gate 28 in FIG. 12 through the time measuring circuit in FIG. 10 or FIG. 16 (as a signal indicative of a failure determination result with respect to the input voltage).

As described above, to meet the essential spirit of the present invention, the control circuit 7 should be prohibited from stopping supplying the power to the discharge lamp 8 or stopping the operation of the lighting circuit, or should be prohibited from lighting a substitute light source or notifying the occurrence of a failure, until the predefined period T31 is elapsed, when detection of a failure is associated with the input voltage.

For this purpose, the configuration illustrated in FIG. 16 maybe used for a variety of failure detector circuits (except for a circuit for detecting a failure in the input voltage to the lighting circuit), in which case the AND gate 40 and the NOT gate 39 are supplied with a failure detecting signal related to the input voltage to the lighting circuit (an output signal of the failure detector circuit) or a failure determining signal (signal indicative of a determination result through a time measuring circuit). Specifically, a variety of failure detector circuits (expect for the circuit for detecting a failure in the input voltage to the lighting circuit) fail to operate when the failure detecting or determining signal is at L level, and determine whether or not associated failures occur when the signal is at H level (when the input signal is normal).

When the input voltage rises and lies within a normal range during the period T31 or the period T24, any failure is no longer recognized in the input voltage, so that the aforementioned items (A) and (B) are eliminated with respect to the detection of the input signal.

For detecting or determining failures other than that in the input voltage to the lighting circuit, setting the period T31 for the item (A) would cause a failed state as previously described to continue, so that the circuit configuration illustrated in FIG. 11 should be employed for this case. For the item (B), which is free from such concern, a circuit which can set the period T31, i.e., the configuration illustrated in FIG. 12 or 16 may be employed. In this case, therefore, two circuits different from each other are provided for respective purposes, i.e., a failure determination circuit for stopping the power supplied to the discharge lamp and stopping the operation of the lighting circuit (a circuit which has no prohibition period set by the delay time generator circuit), and a failure determination circuit for lighting a substitute light source or notifying the lighting of the substitute light source (a circuit has a prohibition period set by the delay time generator circuit).

As is apparent from the foregoing description, according to the first aspect of the invention, since the control circuit is prohibited from stopping the power supply to the discharge lamp or stopping the operation of the lighting circuit, or lighting the substitute light source, or notifying the occurrence of a failure until the predefined time period is elapsed after the lighting circuit has started the operation, it is possible to prevent malfunctions of the control circuit due to a shift in open/close timing of the switch means. Thus, for example, the control circuit is prevented from erroneously determining a failure though the operation of the lighting circuit is normal.

According to the second aspect of the invention, the time measuring operation of the time measuring circuit is started with a delay of a predefined time from the time the lighting circuit starts operating, so that a determination period set for carefully determining a failure is not invaded by the predefined time.

According to the third aspect of the invention, even if the first over-current protecting means acts to break the power supply to the lighting circuit, the operation of the control circuit is ensured as long as it can receive a power supply voltage from the direct current power source through the second over-current protecting means or a supply voltage from another line.

According to the fourth aspect of the invention, the prohibition of the protective operation and auxiliary operation during the predefined time period is limited only to the detection of a failure in the input voltage to the lighting circuit, thereby making it possible to prevent an evil influence resulting from a longer time required to provide a result for detection and determination of failures other than those of the input voltage.

What is claimed is:

1. A discharge lamp lighting circuit comprising:

a lighting circuit which receives power from a power source and lights a discharge lamp;

a control circuit which detects an occurrence of a failure in a discharge lamp or the lighting circuit, the control circuit stops the power supplied to the discharge lamp or operation of the lighting circuit, and lights another light source as a substitute light source for the discharge light, or notifies the occurrence of the failure;

at least two switching means, one being connected to said lighting circuit for receiving power from the power source, while the other being connected to said control circuit for receiving another power from the power source, the respective switches being switched on substantially in synchronization with one another;

wherein said control circuit is prohibited from stopping the power supply to the discharge lamp, or stopping the operation of the lighting circuit, or lighting the substitute light source, or notifying the occurrence of a failure until a predefined time period is elapsed from the time said switch means are switched on to cause the lighting circuit to start operating.

2. A discharge lamp lighting circuit according to claim 1, further comprising a time measuring circuit for determining the occurrence of a failure based on whether a failed state has continued over a predetermined time period, wherein a time measuring operation of said time measuring circuit is delayed by a predefined time period from the time at which the lighting circuit starts operating.

3. A discharge lamp lighting circuit according to claim 1, wherein a supply voltage from a direct current power source through a first over-current protecting means is supplied to a direct current power supply unit, and a supply voltage from said direct current power source through a second over-current protecting means or another supply voltage or a voltage generated from said voltage is supplied to said control circuit as a power supply voltage.

4. A discharge lamp lighting circuit according to claim 1, wherein said control circuit is prohibited from stopping the power supplied to the discharge lamp, or stopping the operation of the lighting circuit or stopping the lighting of the substitute light source, or notifying the occurrence of a failure only when said control circuit detects that the failure has occurred in an input voltage to the lighting circuit.

5. A discharge lamp lighting circuit according to claim 4, wherein said control circuit is prohibited only from lighting the substitute light or notifying the occurrence of a failure until said predefined time period is elapsed when said control circuit detects that a failure has occurred in the input voltage to the lighting circuit, while said control circuit is not prohibiting from stopping the power supplied to the discharge lamp or stopping the operation of the lighting circuit based on a cause other than the failure in the input voltage.

* * * * *